US008356415B2

(12) United States Patent
Lin

(10) Patent No.: US 8,356,415 B2
(45) Date of Patent: Jan. 22, 2013

(54) SCRAPING TOOL WITH BLADE LOCK ASSEMBLY

(76) Inventor: Wen-Chen Lin, Taichung (TW)

( * ) Notice: Subject to any disclaimer, the term of this patent is extended or adjusted under 35 U.S.C. 154(b) by 558 days.

(21) Appl. No.: 12/641,448

(22) Filed: Dec. 18, 2009

(65) Prior Publication Data

US 2011/0146083 A1 Jun. 23, 2011

(51) Int. Cl.
*A47L 13/02* (2006.01)

(52) U.S. Cl. ..... 30/169; 30/338; 15/236.01

(58) Field of Classification Search ..... 30/169, 30/338, 339; 24/498, 515; 403/DIG. 4, 314, 403/374.5; 411/384; 15/236.01–236.08; D32/46, 49; 269/3, 6, 95, 228
See application file for complete search history.

(56) References Cited

U.S. PATENT DOCUMENTS

| | | | | | |
|---|---|---|---|---|---|
| 192,853 | A | * | 7/1877 | Victory | 403/374.5 |
| 855,905 | A | * | 6/1907 | Rhoads | 269/3 |
| 911,536 | A | * | 2/1909 | Banke | 30/169 |
| 1,019,094 | A | * | 3/1912 | Skahen | 24/498 |
| 1,854,286 | A | * | 4/1932 | Abrahamsen | 30/171 |
| 2,185,782 | A | * | 1/1940 | Brittin | 403/374.5 |
| 2,257,314 | A | * | 9/1941 | Shinn, Jr. | 30/169 |
| 2,392,273 | A | * | 1/1946 | Soldani | 15/236.01 |
| 2,463,451 | A | * | 3/1949 | Yates | 24/67.5 |
| 2,494,455 | A | * | 1/1950 | Soldani | 30/333 |
| 2,975,505 | A | * | 3/1961 | Linskey et al. | 24/498 |
| 3,101,185 | A | * | 8/1963 | Gustafson | 24/67.5 |
| 4,106,181 | A | * | 8/1978 | Mattchen | 403/374.5 |
| 4,202,093 | A | * | 5/1980 | Wallerstein | 30/169 |
| 4,381,604 | A | * | 5/1983 | Horst | 30/169 |
| 4,542,554 | A | * | 9/1985 | Wallerstein | 15/236.02 |
| 4,557,503 | A | * | 12/1985 | Linn | 24/515 |
| 4,575,936 | A | * | 3/1986 | Gringer | 30/169 |
| 4,612,707 | A | * | 9/1986 | Shea | 30/169 |
| 4,955,138 | A | * | 9/1990 | Henke et al. | 30/169 |
| D320,921 | S | * | 10/1991 | Henke et al. | D8/98 |
| 5,056,226 | A | * | 10/1991 | Gringer | 30/169 |
| 5,208,984 | A | * | 5/1993 | Negus | 30/169 |
| 5,364,057 | A | * | 11/1994 | Pynenburg | 24/498 |
| RE34,979 | E | * | 6/1995 | Gringer | 30/169 |
| 5,584,461 | A | * | 12/1996 | Pynenburg | 24/498 |
| 5,865,560 | A | * | 2/1999 | Mercat et al. | 403/DIG. 4 |
| 5,924,204 | A | * | 7/1999 | Lane | 30/169 |
| 5,996,231 | A | * | 12/1999 | Roche et al. | 30/169 |
| 6,098,859 | A | * | 8/2000 | Bortner | 24/498 |
| 6,237,225 | B1 | * | 5/2001 | Tarrant | 30/169 |
| 6,519,801 | B1 | * | 2/2003 | Chao | 15/236.01 |
| 6,715,210 | B2 | * | 4/2004 | Chao | 30/169 |
| 6,751,869 | B2 | * | 6/2004 | Paggeot | 30/169 |
| 6,832,416 | B2 | * | 12/2004 | Dixon | 24/498 |
| 6,854,187 | B2 | * | 2/2005 | Huan | 30/339 |

(Continued)

*Primary Examiner* — Jason Daniel Prone
(74) *Attorney, Agent, or Firm* — Rabin & Berdo, P.C.

(57) ABSTRACT

The invention is related to a scraping tool that can be assembled and replaced for scraper blade quickly. The scraping tool in general comprises a stick for hand grasp and a scraping section in the front. The invention mainly uses an arm of suitable length extended from the back end of a jaw clamp toward the middle. It uses fasteners to be located inside the groove in the back of the scraping section. The fastener is also used as pivot for the arm to swing back and forth. On the arm in the back of the jaw clamp, there is a control button that provides vertical pushing force in the back of the jaw clamp and allows strong clamping force in the front of the jaw clamp onto the scraper blade to achieve stable assembly and fast replacement for scraper blade.

7 Claims, 6 Drawing Sheets

U.S. PATENT DOCUMENTS

| | | | | |
|---|---|---|---|---|
| 6,972,042 | B2 * | 12/2005 | Benson | 403/DIG. 4 |
| 7,272,878 | B2 * | 9/2007 | Dixon | 269/3 |
| 7,314,331 | B1 * | 1/2008 | Koros et al. | 403/DIG. 4 |
| D587,871 | S * | 3/2009 | van Deursen et al. | D32/46 |
| 7,562,943 | B2 * | 7/2009 | Kanehisa | 403/374.5 |
| D615,262 | S * | 5/2010 | Bunnag et al. | D32/49 |
| 7,814,608 | B1 * | 10/2010 | Catello | 15/236.01 |
| 7,930,831 | B2 * | 4/2011 | Lin | 30/169 |
| 8,016,278 | B2 * | 9/2011 | Dixon | 269/6 |
| 8,171,646 | B2 * | 5/2012 | Chiu | 30/169 |
| 8,302,317 | B2 * | 11/2012 | Lin | 30/169 |
| 2004/0143924 | A1 * | 7/2004 | Salmon | 30/169 |
| 2007/0052145 | A1 * | 3/2007 | Cantin | 269/6 |
| 2007/0294850 | A1 * | 12/2007 | Murphy et al. | 15/236.01 |
| 2009/0188066 | A1 * | 7/2009 | Van Deursen et al. | 15/236.01 |
| 2009/0188116 | A1 * | 7/2009 | van Deursen et al. | 30/169 |
| 2009/0199411 | A1 * | 8/2009 | van Deursen et al. | 30/169 |
| 2009/0223064 | A1 * | 9/2009 | Venderley | 30/169 |
| 2010/0077620 | A1 * | 4/2010 | Lin | 30/169 |
| 2011/0119853 | A1 * | 5/2011 | Chen | 15/236.01 |
| 2012/0110766 | A1 * | 5/2012 | Lin | 15/145 |
| 2012/0110769 | A1 * | 5/2012 | Lin | 15/245.1 |
| 2012/0198664 | A1 * | 8/2012 | Kolasa | 24/498 |

* cited by examiner

SCRAPING TOOL WITH BLADE LOCK ASSEMBLY

BACKGROUND OF THE INVENTION

1. Field of the Invention

The invention is related to a scraping tool to remove surface residues on wall or ground. Especially it refers to a scraping tool that can be assembled quickly and replaced for scraper blade.

2. Description of the Prior Art

To assure the flatness in replacing wallpaper or carpet, it is necessary to remove surface adhesive residues and adhesives completely. FIG. 1 and FIG. 2 show the structural disassembly diagram and assembly diagram for a known scraping tool. The scraping tool generally comprises a stick 10 for hand grasp and a scraping section 11 in the front. The back of the scraping section 11 forms a combination column 12 that can go into the stick 10 for connection. In the front of the scraping section 11 there is a jaw 13 and a clamp 14 that with several screws 17 run between a jaw 13 and a jaw clamp 15. A scraper blade 16 is put in the clamp 14 and protrudes forward. Therefore, a user can grasp the two ends of the stick 10 and apply force to clear up the surface residues and adhesives on wall or ground by the scraper blade 16. A further investigation into the assembly structure of the above well-known scraping tool will reveal the following drawbacks:

First, when the scraper blade 16 is assembled inside the clamp 14 of the scraping section 11, it uses the pressing and tightening force provided by the screws 17 running between the jaw clamp 15 and the scraping section 11. To achieve the tightening, there will be at least three screws 17. In other words, it is necessary to repeatedly loosen and tighten three screws 17 to replace the scraper blade 16. This causes a great deal of inconvenience.

Second, the jaw clamp 15 uses screws 17 to apply tightening force on the scraper blade 16. But the scraper blade 16 deviates the screw 17 tightening force and is located on one side. When the screws are not appropriately tightened, the scraper blade 16 may be subject to severe opposite force when it is used for high-impact scraping. If the scraper blade 16 is not assembled properly, there is always a risk of jumping out of the clamp 14 of the scraping section 11.

The invention is to improve the above drawbacks associated with the assembly structure of the known scraping tool.

SUMMARY OF THE INVENTION

The objective of the invention is to provide a scraping tool that can be assembled quickly and replaced for scraper blade. It is mainly composed of a jaw clamp that uses a fastener to attach to the back of a scraping section. The jaw clamp can swing back and forth with the fastener as pivot. On the scraping section there is a control button at the position that corresponds to the arm at the back end of the jaw clamp and the control button provides vertical push force against the arm at the back end of the jaw clamp. Therefore, it allows the front end of the jaw clamp works with the clamp of the scraping section to tighten the scraper blade and achieve the objectives of assembly stability and quick replacement for the scraper blade.

To achieve the above objectives, the scraping tool that can be assembled quickly and replaced for scraper blade mainly comprises an arm of suitable length extended from the back end of a jaw clamp toward the middle, a groove of equivalent shape to the jaw clamp at the back of the scraping section, fasteners by which the two sides of the jaw clamp are attached into the groove of the scraping section and as pivot to allow the jaw clamp to swing back and forth within the groove, a receptor at a position of the scraping section that corresponds forwardly to the arm at the back end of the jaw clamp and containing a long guide hole penetrating through the back groove to engage a long guide block inside to provide vertical sliding, a pillar at the bottom of the guide block, a control button which front side forms a release side with front edge and a pressure valve side with bottom edge, and wings at the back end for finger sliding and being able to rotate 90 degrees with a bolt as axle to connect to the top of the receptor in the front of the scraping section. When the control button operates 90-degree vertically in the long guide hole of the receptor, the release side in the front edge will correspond to the top of the long guide block and the guide block is free of pressure and able to move upward inside the guide hole. It also means the jaw clamp can swing inside the groove without holding the scraper blade. Thus, the scraper blade can freely move in or out of the clamp in the scraping section to achieve the objective of fast replacement. When the control button operates 90-degree horizontally, the pressure valve side at the bottom edge will correspond to the top of the long guide block and the guide block is under pressure without being able to move upward inside the guide hole. This also means the pillar at the bottom edge will push against the arm at the back end of the jaw clamp to generate a strong force for the front of the of the jaw clamp to grasp the scraper blade and achieve the objective of assembly stability for scraper blade.

DETAILED DESCRIPTION OF THE INVENTION

Figure 1:
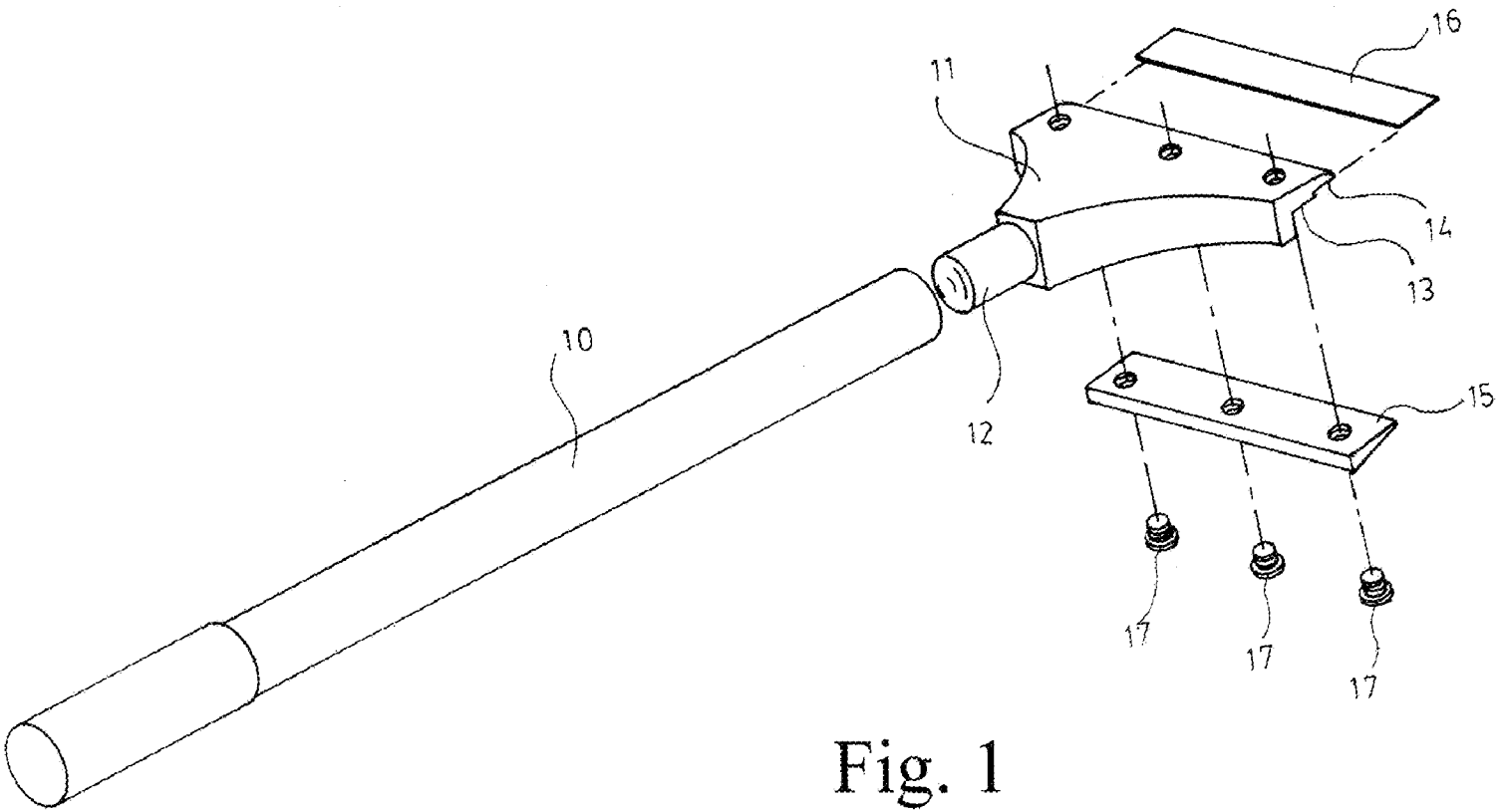
FIG. 1 is the structural disassembly diagram for a known scraping tool.
Figure 2:
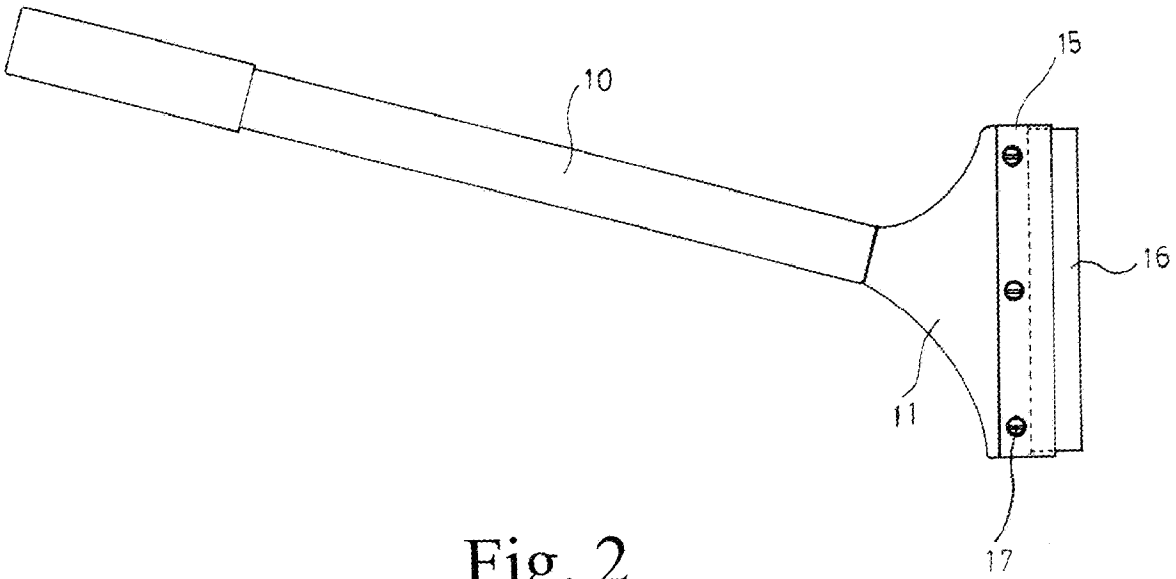
FIG. 2 is the structural assembly diagram for a known scraping tool.
Figure 3:
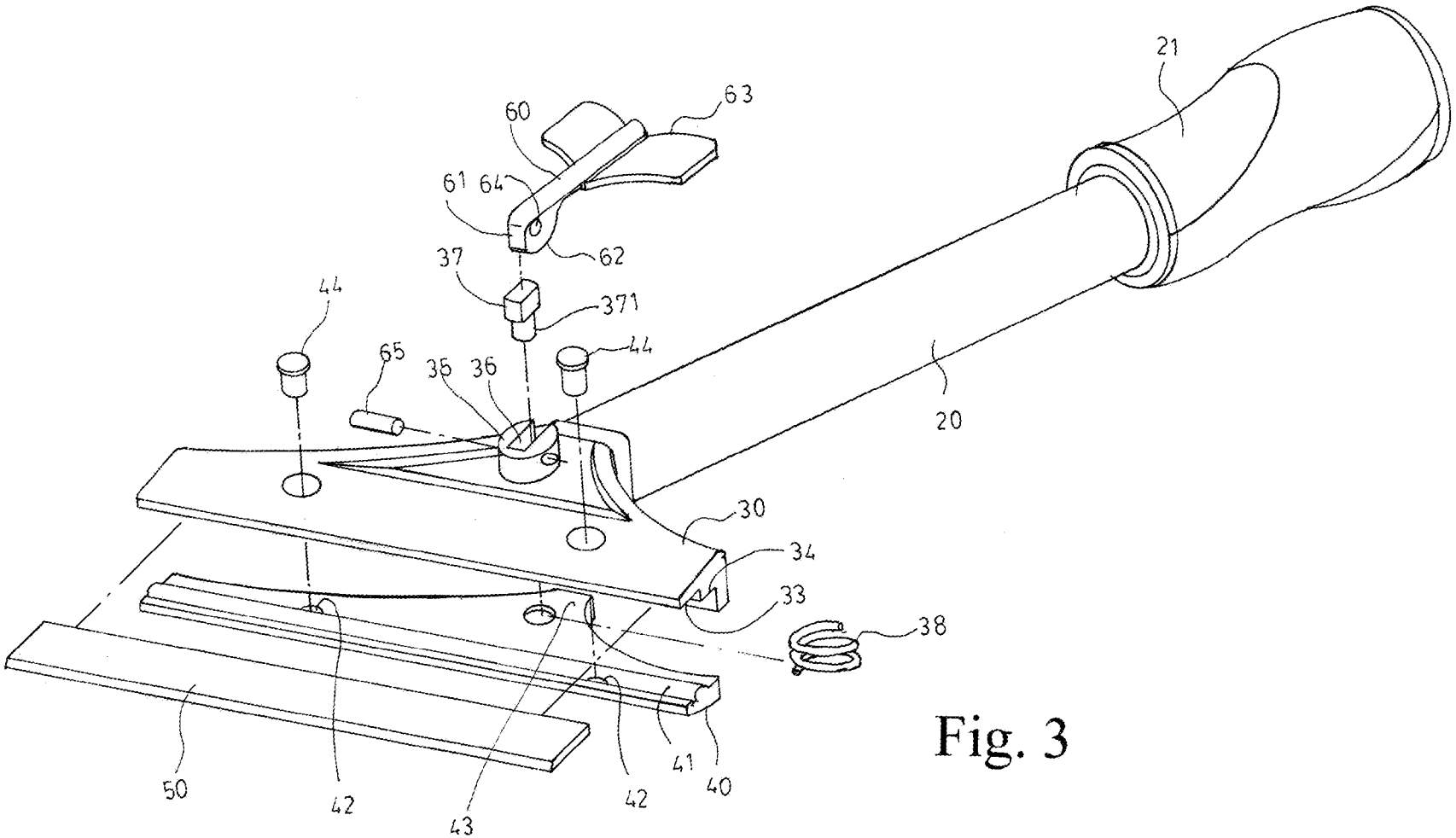
FIG. 3 is the disassembly diagram for the scraping tool in the invention that can be assembled and replaced for scraper blade quickly.
Figure 4:
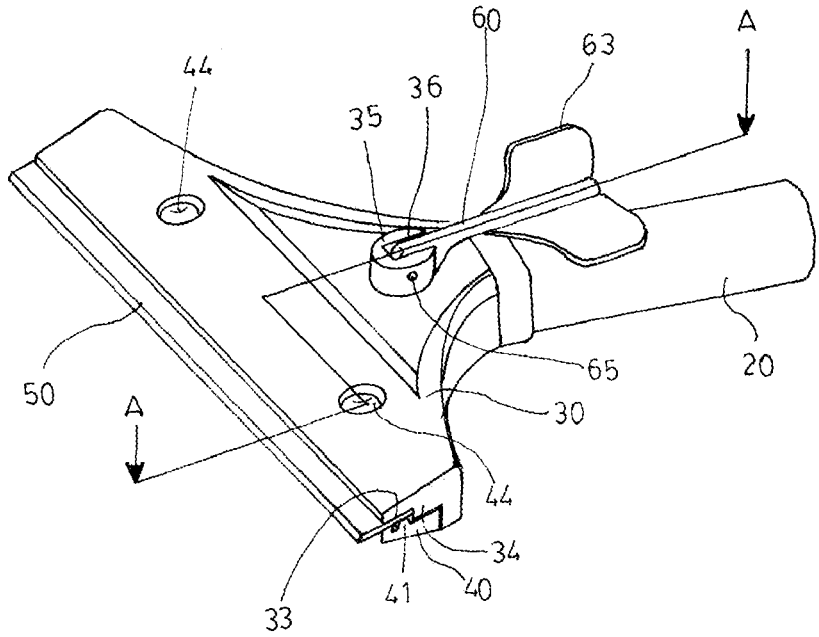
FIG. 4 is the assembly diagram for the scraping tool in the invention that can be assembled and replaced for scraper blade quickly.
Figure 5:
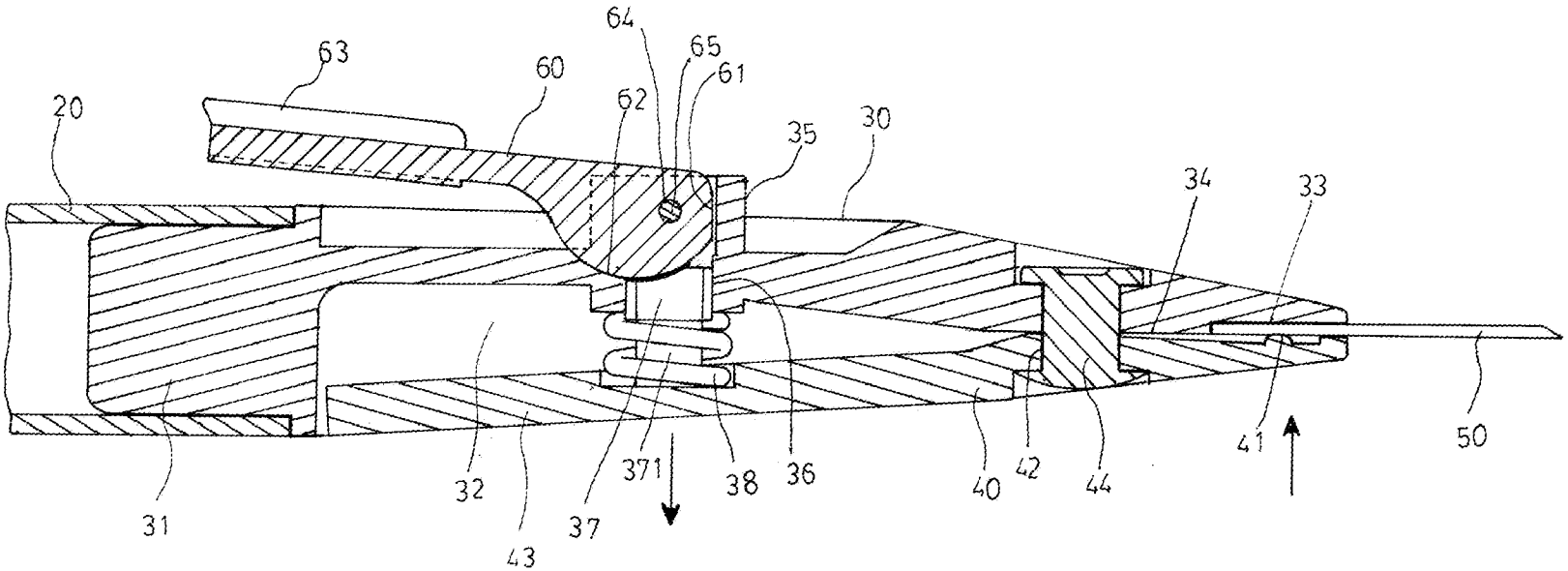
FIG. 5 is the A-direction cross-sectional diagram for FIG. 4.

The following uses figures with a preferred embodiment to explain the characteristics and function for the invention:

Please refer to FIG. 3, FIG. 4 and FIG. 5 for the disassembly diagram, assembly diagram and cross-sectional diagram for the scraping tool in the invention that can be assembled and replaced for scraper blade quickly. The scraping tool contains some components that are similar in a known scraping tool. They are a stick 20 for hand grasp and a scraping section assembly in the front. The back of the stick 20 is coupled with a grip 21. The scraping section assembly is composed of a scraping section 30. a jaw clamp 40, a scraper blade 50 and a control device (including a control level with wings, described as a control button 60 in the specification, a bolt 65, and a guide block 37 with a bottom pillar 371). On the jaw clamp 40 a rib 41 for attachment is laterally located at inner front edge and combination holes 42 are at two sides and an arm 43 of a suitable length extends backwards, and tapers, from the rib 41. The jaw clamp 40 uses two fasteners 44 to run through the combination holes 42 and be located inside the groove 32 of the scraping section 30; and also uses the two fasteners 44 as pivot to swing back and forth inside the groove 32. The combination column 31 at the back end of the scraping section 30 is coupled with the stick 20 by penetrating into it. On the back of the scraping section 30 there are grooves 32 of similar shape to jaw clamp 40. There are a damp 33 and a jaw 34 in the front of the groove 32. There is a receptor 35 formed at a position corresponding to the arm 43 at the back end of the jaw damp 40. Inside the receptor 35 there is a long and flat guide hole 36 penetrating through the back of the groove 32 and to restrict the vertical sliding of the long and flat guide block 37 by coupling with it. At the bottom of the guide block 37 there is the pillar 371. There is a compression spring 38 coupled with the pillar 371. The control button 60 at its front side forms a release side 61 with front edge and a pressure valve side 62 with bottom edge and wings 63 at the back end for finger sliding. Between the pressure valve side 62 and the release side 61 there is an axle hole 64, the distance from which to the release side 61 is smaller than that to the pressure valve side 62. When the bolt 65 runs through the axle hole 64 and is coupled with the receptor 35, the control button 60 can operate 90-degree movement on the top edge of the receptor 35.

Figure 7:
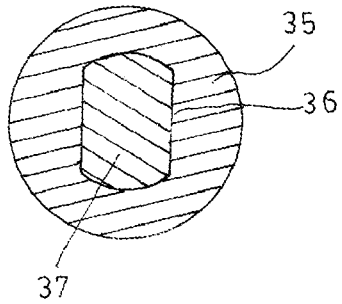
FIG. 7 is an illustration for the guide block to couple with the receptor in the invention.

Please refer to FIG. 5 and FIG. 7. When the control button 60 operates 90-degree laterally downward at the receptor 35 of the scraping section 30, the pressure valve side 62 at its bottom edge will approach the top of the guide block 37 with a convex surface and push the guide block 37 in the guide hole 36 of the receptor 35 downward. On the top of the guide block 37 there is a concave surface corresponding to the pressure valve side 62. The guide holes 36 for the guide block 37 and the receptor 35 are long and flat and in equal length. Therefore, it can define the downward movement distance for the guide block 37 inside the guide hole 36 of the receptor 35. That means the guide block 37 can use its pillar 371 to push against the arm 43 at the back end of the jaw clamp 40 and provide a vertical pushing force that generates a huge holding force for the front of the jaw clamp 40 onto the scraper blade 50 to achieve the objectives for fast assembly and stable assembly for the scraper blade 50.

Figure 6:
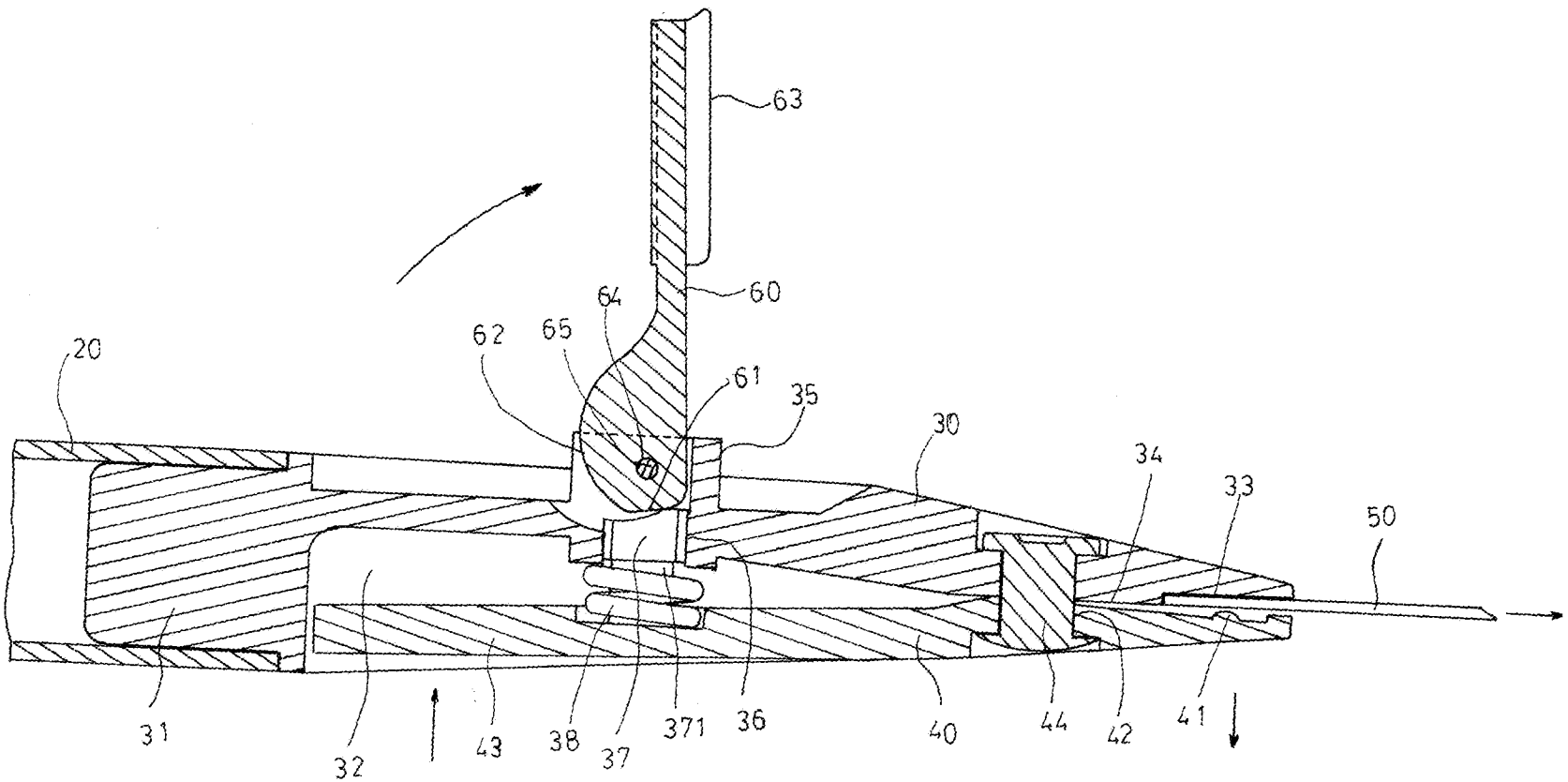
FIG. 6 is an illustration for the scraping tool in the invention that can be assembled and replaced for scraper blade quickly.

Please refer to FIG. 6. When the control button 60 operates 90-degree vertically in the receptor 35 of the scraping section 30, the release side 61 at its front will correspond to the top of the guide block 37. Because the distance between the axle hole 64 and the release side 61 is reduced, there is room for the guide block 37 to move upward in the guide hole 36 of the receptor 35. It will further push the arm 43 at the back end of the jaw clamp 40 and swing with the fasteners 44 as pivot. This allows separation of jaw clamp 40 and the clamp 33 of the scraping section 30. Thus, the objective of fast replacement of scraper blade 50 is achieved. As for the compression spring 38 coupled with the pillar 371, its purpose is to provide an appropriate tension at the back end of the jaw clamp 40 that enables a proper tightening of scraper blade 50 in the front.

The above figures and description are only for a preferred embodiment of the invention; those equivalent modifications or alteration based on the principle of the invention by people familiar with the skills shall fall into the scope of claims by the patent application.

What is claimed is:

1. A scraping tool, comprising:

a stick for hand grasp; and a scraping section assembly attachable to a front end of the stick, the scraping section assembly including a scraping section, a jaw clamp, a scraper blade and a control device, wherein the jaw clamp has a lateral rib and an arm of a suitable length extending backwards, and tapering, from the lateral rib;

the scraping section includes a groove formed thereon with a shape corresponding to the jaw clamp, a clamp and a jaw formed laterally along a front end of the groove, and a receptor at a position corresponding to the arm of the jaw clamp, the receptor having a guide hole formed therein penetrating through the scraping section; and the control device includes a control lever, a bolt, and a guide block with a bottom pillar configured to be placed in the guide hole of the receptor, the control lever having a front edge, a bottom edge, and an axle hole formed between the front and bottom edges, the bolt being placeable in the axle hole to attach the control lever to the receptor, such that when the control level is turned around the bolt, the bottom edge or the front edge is in contact with the guide block, to thereby fix or release the scraper blade between the scraping section and the jaw clamp.

2. The scraping tool of claim 1, wherein the axle hole is of a shorter distance to the front edge than to the bottom edge.

3. The scraping tool of claim 1, wherein the bottom edge is convex.

4. The scraping tool of claim 1, wherein the guide hole is flat and of suitable length, and the bottom pillar of the guide block is of a shape corresponding to that of the guide hole to facilitate restriction on vertical slicing.

5. The scraping tool of claim 1 wherein the jaw clamp is pivotally connected to the scraping section by a plurality of fasteners, to thereby allow the jaw clamp to pivot back and forth in the groove.

6. The scraping tool of claim 1, wherein the rib fixes the scraper blade stably inside the clamp of the scraping section.

7. The scraping tool of claim 1, wherein a back of the jaw clamp is subject to a vertical push force to provide a clamping force in a front thereof.

* * * * *